US007964822B2

(12) United States Patent
Suen

(10) Patent No.: US 7,964,822 B2
(45) Date of Patent: Jun. 21, 2011

(54) PAINT REMOVER FOR USE WITH A HEAT GUN

(76) Inventor: Chi Ming Suen, Kowloon (HK)

( * ) Notice: Subject to any disclaimer, the term of this patent is extended or adjusted under 35 U.S.C. 154(b) by 283 days.

(21) Appl. No.: 12/378,982

(22) Filed: Feb. 23, 2009

(65) Prior Publication Data

US 2010/0212095 A1 Aug. 26, 2010

(51) Int. Cl.

| | |
|---|---|
| ***H05B 3/00*** | (2006.01) |
| ***A47L 13/02*** | (2006.01) |
| ***A47L 13/022*** | (2006.01) |
| ***B26B 3/00*** | (2006.01) |

(52) U.S. Cl. ..... 219/228; 219/227; 219/242; 15/93.1; 15/93.4; 15/105; 392/385

(58) Field of Classification Search ..... None
See application file for complete search history.

(56) References Cited

U.S. PATENT DOCUMENTS

| | | | | | |
|---|---|---|---|---|---|
| 2,133,922 | A | * | 10/1938 | Laskin | 126/401 |
| 3,109,083 | A | * | 10/1963 | Meltzer | 219/228 |
| D296,070 | S | | 6/1988 | Cunningham | |
| 4,849,607 | A | * | 7/1989 | Meo | 392/385 |
| 5,208,895 | A | * | 5/1993 | Hoover et al. | 392/404 |
| 5,313,931 | A | * | 5/1994 | Coulcher et al. | 126/401 |
| 5,575,035 | A | * | 11/1996 | Reis et al. | 15/324 |
| 7,717,104 | B2 | * | 5/2010 | Looft | 126/25 B |

FOREIGN PATENT DOCUMENTS

| | | | |
|---|---|---|---|
| DE | 3708620 | A | * 10/1988 |
| FR | 2481983 | A | * 11/1981 |

* cited by examiner

*Primary Examiner* — Joseph M Pelham
(74) *Attorney, Agent, or Firm* — Lee W. Tower

(57) ABSTRACT

A paint remover including a receptacle adapted to hold a hot air gun having a hot air output and an attachment coupled to the receptacle for attaching a blade to the receptacle and for aligning the blade with the hot air output.

7 Claims, 5 Drawing Sheets

PAINT REMOVER FOR USE WITH A HEAT GUN

FIELD

This disclosure relates to paint removal, and in particular to paint removal using a heat gun, which is also known as a hot air gun.

BACKGROUND

A heat gun or hot air gun is a device used to emit a stream of hot air. Superficially, a heat gun is similar in shape and construction to a hair dryer, though a heat gun runs at much higher temperatures. Heat guns are often found in physics, materials science, chemistry, engineering, and other types of laboratory or shop settings.

Heat guns can be used to dry and strip paint, apply heat shrink tubing, dry out damp wood, bend and weld plastic, soften adhesives, and thaw frozen pipes. They are also used in electronics to desolder circuit board components. They typically output air at temperatures ranging from 100-550° C. (200-1000° F.) with some hotter models running around 760° C. (1400° F.), although the temperature may vary depending on the application.

Some heat guns have a rest, so they can be activated and placed on a workbench, which frees the operator's hand. Heat guns can have nozzles which deflect their air for various purposes, such as concentrating the heat on one area.

In the prior art, when used to dry and strip paint, a heat gun is used to heat the paint as much as required to make it malleable and thereafter the paint is stripped off a painted surface with a separate paint scraper tool. One form of paint scraper is the classic putty knife, which typically has a stiff flat ended blade.

Gloves are generally worn during the heating process to protect the operator's hands and the scraping tool must be compatible with the heat gun so that it can resist higher temperatures. An operator heats a portion of a painted surface with the heat gun, and then scrapes the paint using the separate paint scraper. Use of the heat gun and the separate paint scraper requires the operator to switch the tools in his hands. For example, if the operator is right handed, then it is natural to want to operate the heat gun and the separate paint scraper with the same hand. This may require the operator to lay down one or the other of the tools, which means the paint stripping operation takes longer to perform.

It is also important to hold the heat gun at a stipulated distance away from the material, so that the heat gun is not so close as to burn the paint or too far away from the painted surface. Keeping the heat gun at a certain distance away from the painted surface is difficult, especially when switching between the heat gun and the separate paint stripper and can be tiring to the operator.

What is needed is a device that makes paint stripping easier to perform and that ensures that the heat gun is kept a certain distance away from the painted surface. The embodiments of the present disclosure answer these and other needs.

SUMMARY

In a first embodiment disclosed herein, a paint remover includes a receptacle adapted to hold a hot air gun having a hot air output and an attachment coupled to the receptacle for attaching a blade to the receptacle and for aligning the blade with the hot air output.

In another embodiment disclosed herein, a heat gun having a hot air output includes an attachment coupled to the heat gun, the attachment adapted to attach a blade to the heat gun and align the blade with the hot air output.

In yet another embodiment disclosed herein, a method for providing a paint remover includes selecting a heat gun and coupling an attachment to the heat gun for attaching a blade.

These and other features and advantages will become further apparent from the detailed description and accompanying figures that follow. In the figures and description, numerals indicate the various features, like numerals referring to like features throughout both the drawings and the description.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
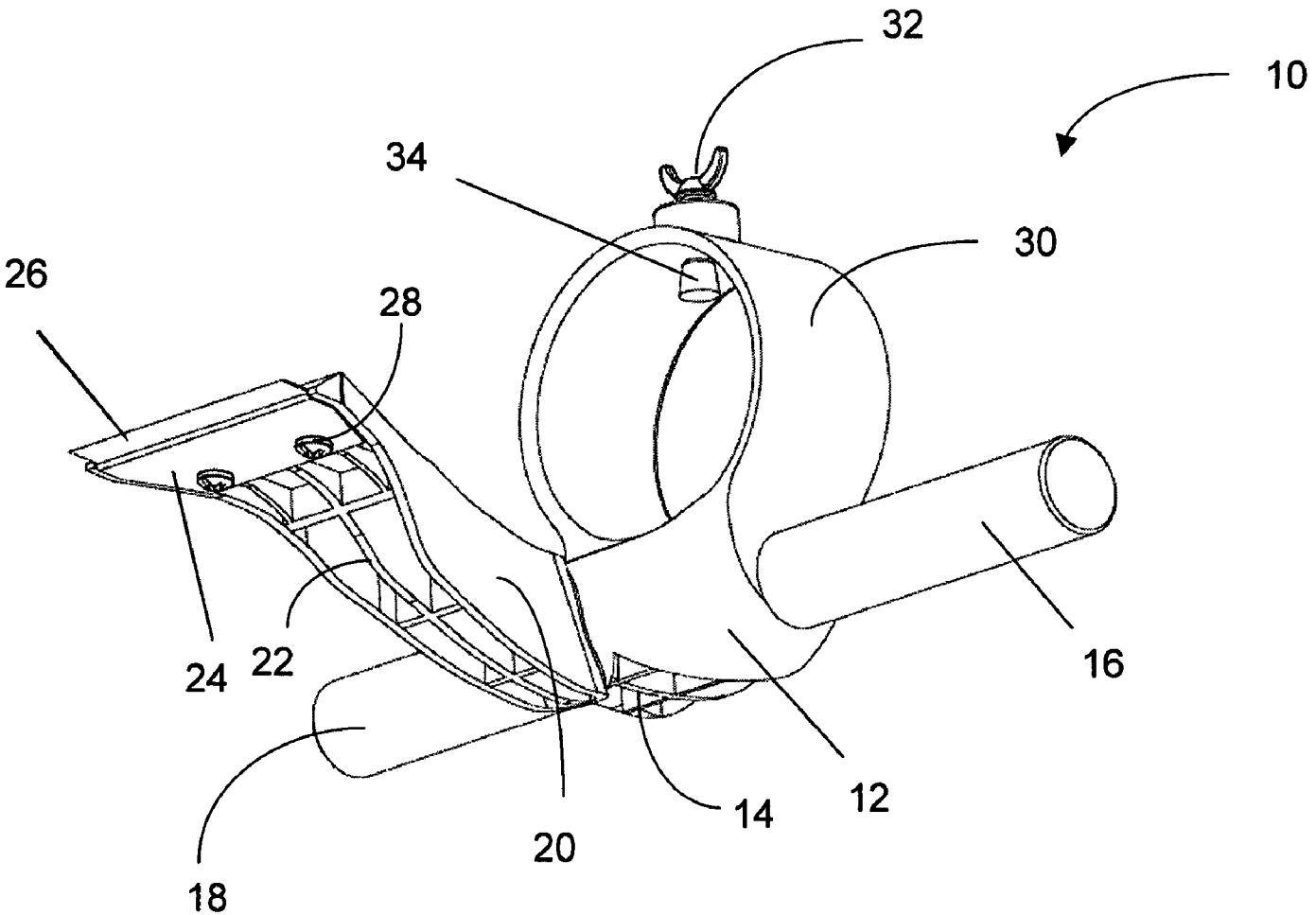
FIG. 1 shows a paint remover in accordance with the present disclosure.

Referring to FIG. 1, a paint remover 10 is shown that has a receptacle 30, a first frame piece 12, a second frame piece 20, and an attachment 24, 28 for attaching blade 26, which may be removably attached. The receptacle 30 shown has a cylindrical form for holding the body of a heat gun. Although the receptacle shown in FIG. 1 has a cylindrical form, the receptacle can have any form that is suitable for holding a heat gun. The heat gun may be fastened to the receptacle 30 by adjusting an adjustable fastener 32. When the adjustable fastener 32 is tightened, pin 34 presses against the heat gun holding it within the receptacle 30. Other adjustable fasteners may be used such as straps.

The first and second frame pieces 12 and 20 are attached to receptacle 30 and are reinforced with reinforcement members 14 and 22, respectively, to maintain the alignment of the first and second frame pieces 12 and 20 and thus alignment of the attachment 24, 28 so that blade 26 is aligned with the hot air output of a heat gun held by paint remover 10. Blade 26 may be removably attached at the end of second frame piece 20 by attachment 24, 28 having a plate 24 and screws 28. The attachment may also be any other device for attaching a blade, such as fittings that allow a blade to be slid into the attachment or snapped onto the attachment.

The blade 26 may be many types of blades including but not limited to a flat ended blade, such as found on a classic putty knife, or blade 26 may be a razor blade.

Handles 16 and 18 may be attached to either side of paint remover 10 to provide operator handles to manipulate the paint remover to scrape paint from a painted surface.

The first and second frame pieces 12 and 20 align the hot air output of a heat gun held by the receptacle 30 with the blade

26. Thus, when the heat gun is blowing hot air, the blade 26 can be used to scrape paint from a painted surface. Because the heat gun is removably attached directly to the paint remover, and because the blade is a fixed distance from the hot air output of the heat gun, then the heat gun may be easily kept at a proper distance from a painted surface while heating the paint on a painted surface. This solves one of the key problems with the prior art. In addition, the operator need not use a separate paint scraper, thus resolving another problem in the prior art.

Figure 2:
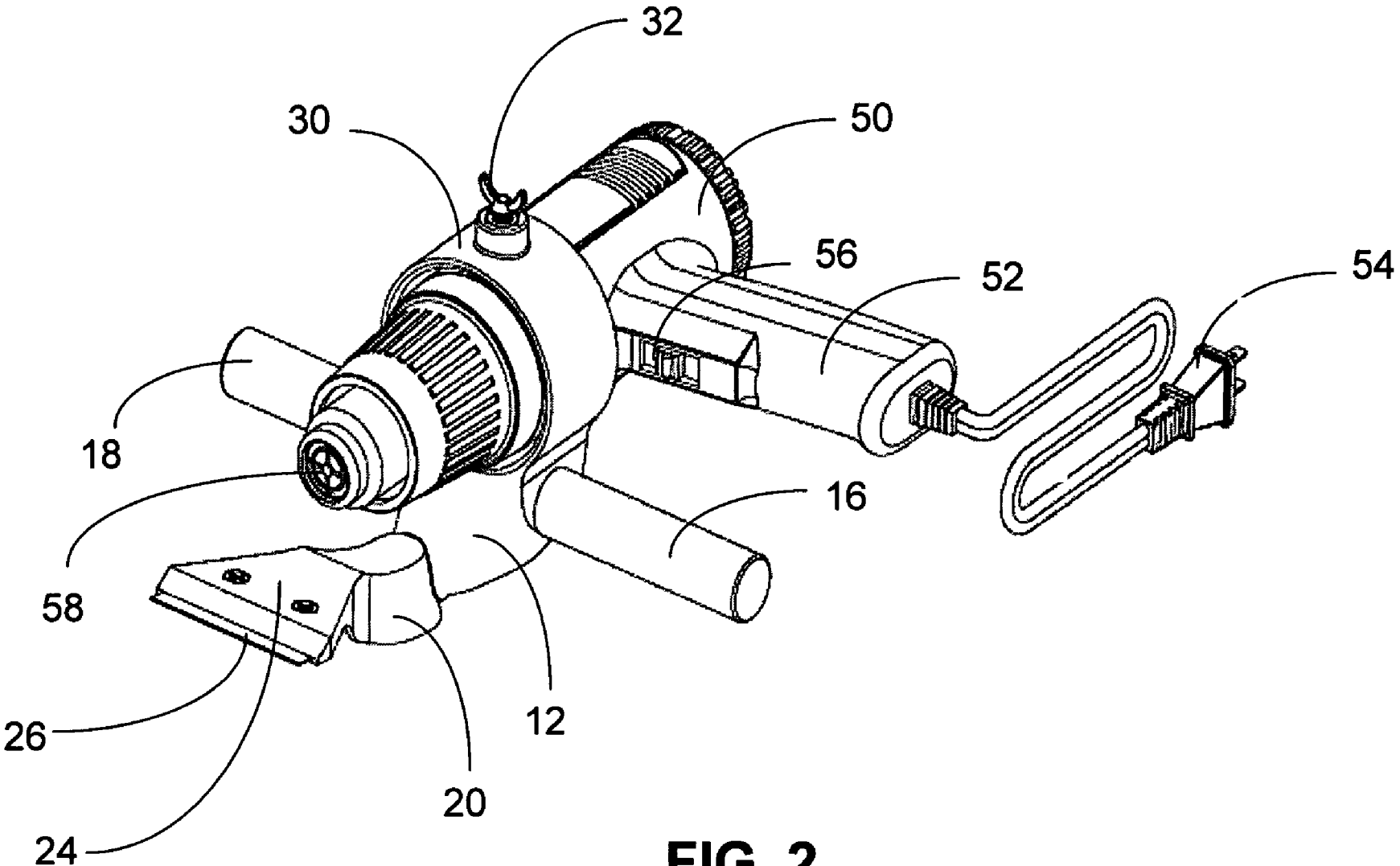
FIG. 2 shows the paint remover of FIG. 1 with a heat gun held therein in accordance with the present disclosure.

FIG. 2 shows heat gun 50 held in the paint remover 10 of FIG. 1. The heat gun 50 has a hot air output at end 58, which is generally aligned with blade 26. In one embodiment, the alignment with blade 26 is such that the heat gun 50 at end 58 may be focused just above blade 26 in order to heat the paint on a surface above the blade 26. After the paint is softened by the hot air, it can be easily scraped off using the blade 26 attached to the paint remover 10.

The heat gun 50 generally has a handle 52 with an on/off trigger 56 and is electrically operated via a cord 54, as shown in FIG. 2, or can be operated with batteries.

Figure 3:
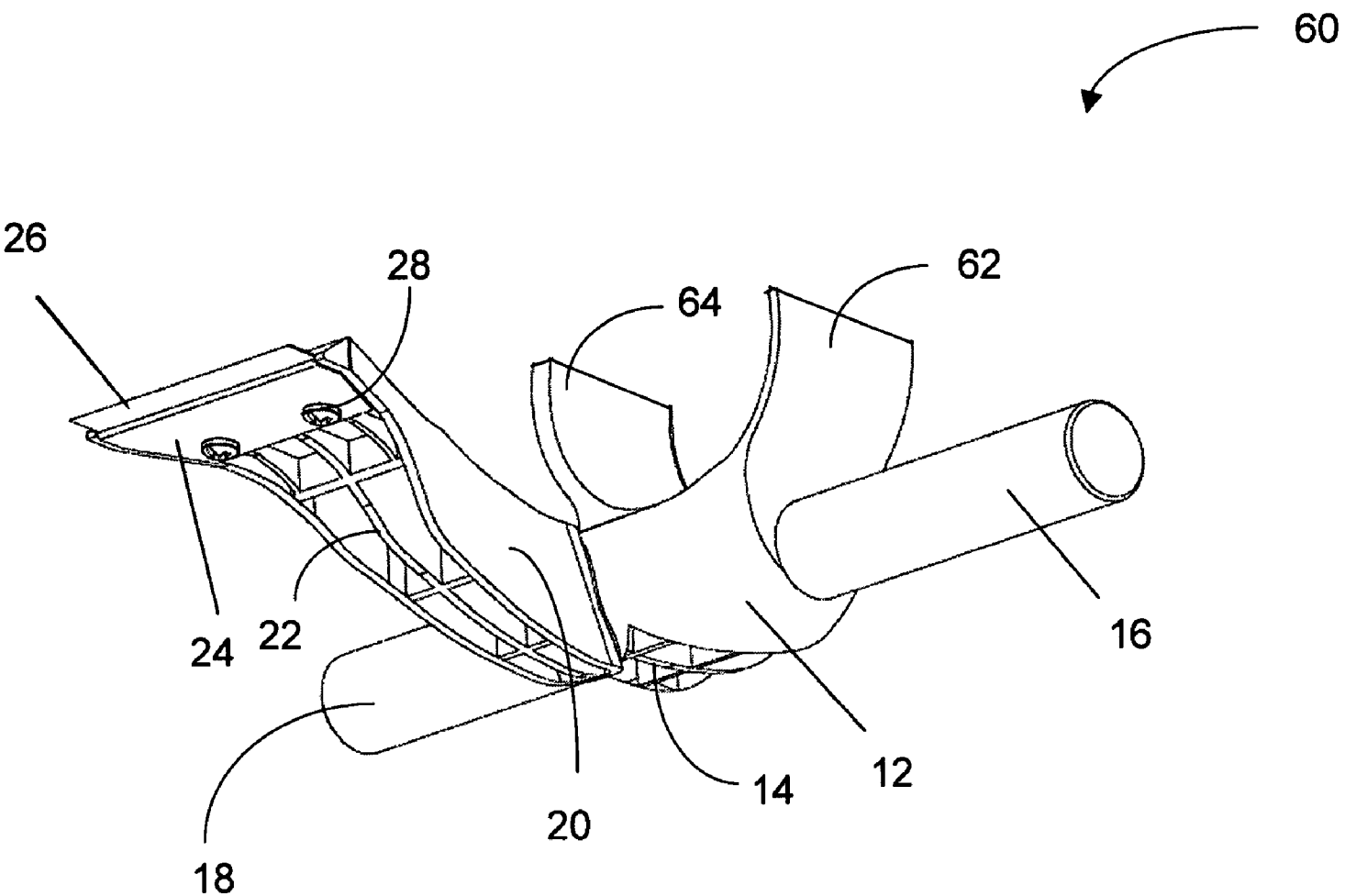
FIG. 3 shows another paint remover in accordance with the present disclosure.

As discussed above the paint remover 10 for holding a hot air gun having a hot air output can have many forms. For example, as shown in FIG. 3 the paint remover 60 has a clamp 62, 64, which provides a receptacle to hold the hot air gun. The clamp 62, 64 may have springs (not shown) or include a mechanical screw vise (not shown) to grip a heat gun tightly. Or, a heat gun can be held in clamp 62, 64 by a strap (not shown) between the clamp sides 62 and 64.

The paint removers 10 and 60 shown in FIGS. 1 and 3, respectively, may be made of plastic or metal.

Figure 4:
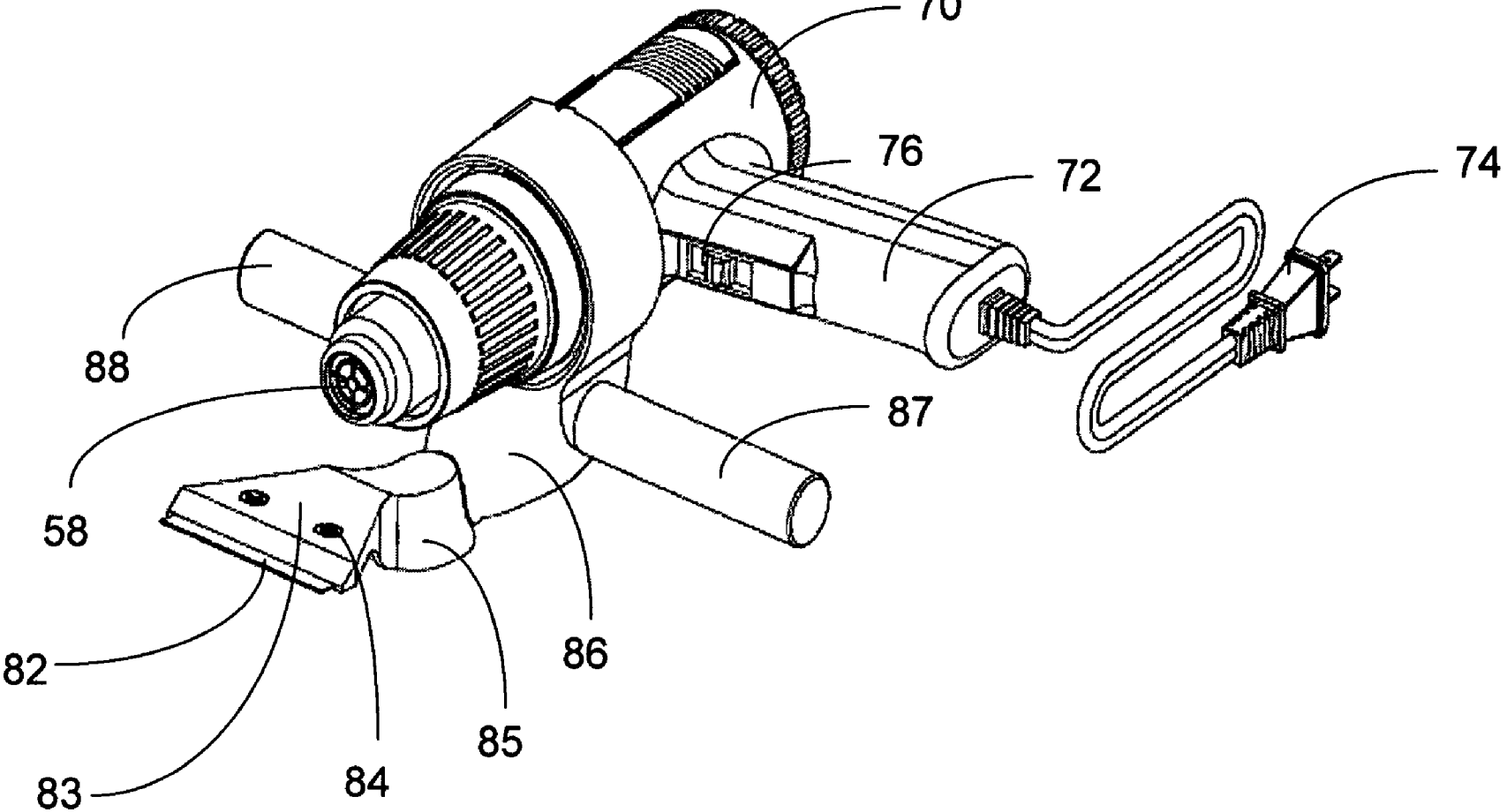
FIG. 4 shows a heat gun with an attachment for a blade in accordance with the present disclosure.

In another embodiment, shown in FIG. 4, a heat gun 70, which produces a hot air output at output 78, has an integral attachment 83, 84 for a blade 82. The attachment may take many forms and may be adapted to removably attach blade 82 to the heat gun 70 and align the blade 82 with the hot air output at output 78. In one embodiment the attachment includes plate 83 and screws 84. The attachment may also be any other device for attaching blade 82, such as fittings that allow a blade to be slid into the attachment or snapped onto the attachment. The blade 82 may be many types of blades including but not limited to a flat ended blade, such as found on a classic putty knife, or the blade 82 could be a razor blade.

The alignment of blade 82 may be such that the output 78 of heat gun 70 is focused just above blade 82 in order to heat the paint on a surface above the blade 82. After the paint is softened by the hot air, it can be easily scraped off using the blade 82.

The heat gun may have a handle 76 with an on/off trigger 56 and be electrically operated via a cord 74, as shown in FIG. 4, or can be operated with batteries. The heat gun 70 may also have other handles 87 and 88. The heat gun 70 may have projections 85 and 86 to align blade 82 with the hot air output.

Figure 5:
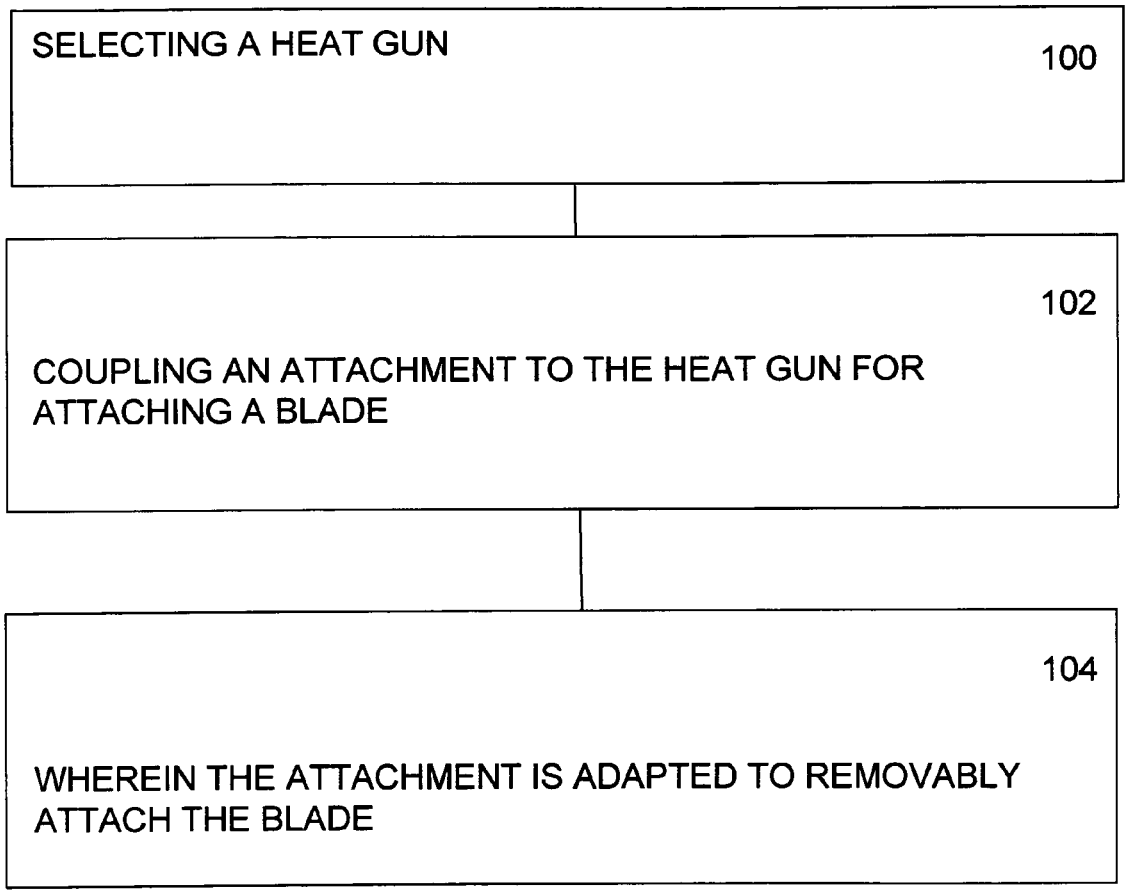
FIG. 5 is a flow diagram for providing a paint remover in accordance with the present disclosure.

FIG. 5 is a method for providing for removal of paint. In step 100 a heat gun is selected. Then in step 102 an attachment is coupled to the heat gun for attaching a blade. The attachment is adapted to removably attach the blade in step 104.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . . "

What is claimed is:

1. A paint remover comprising:

a receptacle comprising a cylinder, the cylinder adapted to hold a hot air gun, the hot air gun having a hot air output aligned along an axis, and wherein when the hot air gun is held within the cylinder, the axis of the hot air output passes through the cylinder;

a first handle extending from one side of the receptacle at an angle normal to the axis;

a second handle extending in a direction opposite to the first handle from an opposite side of the receptacle and at an angle normal to the axis; and an attachment coupled to the receptacle for attaching a blade to the receptacle and for aligning the blade with the hot air output.

2. The paint remover of claim 1 further comprising an adjustable fastener coupled to the receptacle for removably fastening the hot air gun to the receptacle.

3. The paint remover of claim 2 wherein the adjustable fastener comprises a screw type fastener.

4. The paint remover of claim 1 wherein the attachment is adapted to removably attach the blade to the receptacle.

5. The paint remover of claim 4 wherein the attachment comprises screws.

6. The paint remover of claim 1 further comprising a blade coupled to the attachment.

7. The paint remover of claim 1 further comprising a frame coupled between the receptacle and the attachment, the frame having reinforcement members to maintain the alignment of the attachment.

* * * * *